US006805515B2

(12) United States Patent
Reale

(10) Patent No.: US 6,805,515 B2
(45) Date of Patent: Oct. 19, 2004

(54) ASSEMBLY WITH A REMOVABLE BOLLARD

(76) Inventor: George S. Reale, 3444 Marshall Rd., Drexel Hill, PA (US) 19026

( * ) Notice: Subject to any disclaimer, the term of this patent is extended or adjusted under 35 U.S.C. 154(b) by 0 days.

(21) Appl. No.: 10/382,148

(22) Filed: Mar. 5, 2003

(65) Prior Publication Data

US 2004/0175231 A1 Sep. 9, 2004

(51) Int. Cl.[7] ..... E01F 13/04
(52) U.S. Cl. ..... 404/11; 49/49
(58) Field of Search ..... 404/6, 9, 10, 11; 49/35, 49

(56) References Cited

U.S. PATENT DOCUMENTS

| | | | | |
|---|---|---|---|---|
| 2,121,961 A | | 6/1938 | Gill | |
| 3,660,935 A | * | 5/1972 | Boots | 49/35 |
| 4,062,149 A | | 12/1977 | Collins | |
| 4,240,766 A | | 12/1980 | Smith et al. | |
| 4,343,567 A | | 8/1982 | Sarver et al. | |
| 4,715,742 A | * | 12/1987 | Dickinson | 404/6 |
| 5,070,646 A | * | 12/1991 | Colombo | 49/49 |
| 5,090,348 A | | 2/1992 | Hugron | |
| D324,920 S | | 3/1992 | Miller et al. | |
| 5,192,159 A | * | 3/1993 | Higginson | 404/11 |
| D336,346 S | | 6/1993 | Miller et al. | |
| 5,365,694 A | * | 11/1994 | Macaluso | 49/49 |
| 5,481,828 A | * | 1/1996 | Kentrotas | 49/35 |
| 5,520,479 A | | 5/1996 | Hernandez | |
| 5,895,169 A | * | 4/1999 | Holm et al. | 404/9 |
| 5,961,249 A | * | 10/1999 | Hansen et al. | 404/9 |
| 6,065,900 A | | 5/2000 | Reale | |

FOREIGN PATENT DOCUMENTS

| | | | | |
|---|---|---|---|---|
| GB | 1576968 A | * | 10/1980 | E01F/13/00 |

* cited by examiner

*Primary Examiner*—Thomas B. Will
*Assistant Examiner*—Alexandra K. Pechhold
(74) *Attorney, Agent, or Firm*—Duane Morris LLP

(57) ABSTRACT

A removable traffic control bollard has a post and a base for removably receiving the post. The post has a depending cylindrical part that fits into the tube of the base, held by rider elements that fit inside an upper post member of hollow tubing. The base has a faceplate opening into a downwardly depending tube that is embedded in the ground, or the like, preferably with the faceplate at surface level. The faceplate has two locking apertures over a box, and the post has an aperture in a cleat, through which apertures a padlock U-bolt can be inserted to lock the post to the base. The post can be repeatedly inserted into the base and locked into position and, if desired, subsequently removed by unlocking it and pulling it up out of the base.

6 Claims, 6 Drawing Sheets

ASSEMBLY WITH A REMOVABLE BOLLARD

FIELD OF THE INVENTION

The invention relates to post assemblies for controlling ground traffic, and more particularly to the field of post assemblies having a removable post.

BACKGROUND

Barrier traffic control devices are used to physically prevent the flow of traffic into an area and to direct traffic onto desired routes or into other areas. They have been used to control traffic flow on roads, in parking lots, at schools, and universities.

Attempts to address the control of traffic can be found in U.S. Pat. No. 4,240,766 issued to Smith et al on Dec. 23, 1980; U.S. Pat. No. 4,343,567 issued to Sarver et al on Aug. 10, 1982; U.S. Pat. No. 5,090,348 issued to Hugron on Feb. 25, 1992; U.S. Pat. No. 5,895,169 issued to Holm et al on Apr. 20, 1999; and U.S. Pat. No. 6,065,900 issued to Reale on May 20, 2000. Despite this art, there exists a need for a sturdy removable bollard that has a post that is easily secured, removed and replaced. For example, some bollards that are in use are difficult to remove from the ground, particularly when the ground is frozen. Some are extremely heavy because they are filled with cement or other material in an effort to make them stronger. Preferably, the bollard has a post that is light weight, sturdy by design, yet easily secured, removed and replaced.

The present invention relates to a removable post assembly that can be utilized in pedestrian or vehicular traffic control.

There is a need for such devices to be readily removable, sturdy, and securely fastened.

SUMMARY

The present invention is a bollard that satisfies this need. We have determined that a light weight sturdy design can be facilitated by using internal bracing. Preferably, the internal bracing is provided by steel elements that fit within and ride in the internal space a post member, these rider elements serving to guide and support cylindrical member in the post member. The bollard includes a post having an upper post member and cylindrical member. The cylindrical member has an upper portion that extends into the upper post member and lower dependent portion depending from said upper post member. A securing element within the upper post member provided by steel internal bracing secures the cylindrical member in place. The bollard includes a base, a base top plate and a bore extending from the upper end of the base top plate, for matingly receiving the cylindrical member that is held in the upper post member by the rider elements. The faceplate is secured to the upper portion of the base and has a first aperture to permit receipt of the lower cylindrical member of the post. The plate has a locking aperture and a proximate optional second locking aperture to facilitate securing the post to the base with a locking mechanism, such as a padlock.

The assembly includes a base having a bore for receiving the depending lower cylindrical member of the post. A plate is disposed at the upper end of said base. The plate has a first aperture and a second aperture proximate the first. An eye cleat is provided near the lower end of the upper post member. The eye cleat has an aperture that can be placed proximate to and in alignment with one of the apertures of the base plate when the post is mated with the base. A lock, such as a padlock, can be inserted through the aligned cleat plate aperture and then through the other plate aperture. In this manner, the post can be removably secured.

BRIEF DESCRIPTION OF THE DRAWINGS

These and other features, aspects, and advantages of the present invention will become better understood with regard to the following description, appended claims and accompanying drawings where:

DETAILED DESCRIPTION

The present invention will be described hereinafter with reference to the accompanying drawings that illustrate embodiments of the invention.

Figure 1:
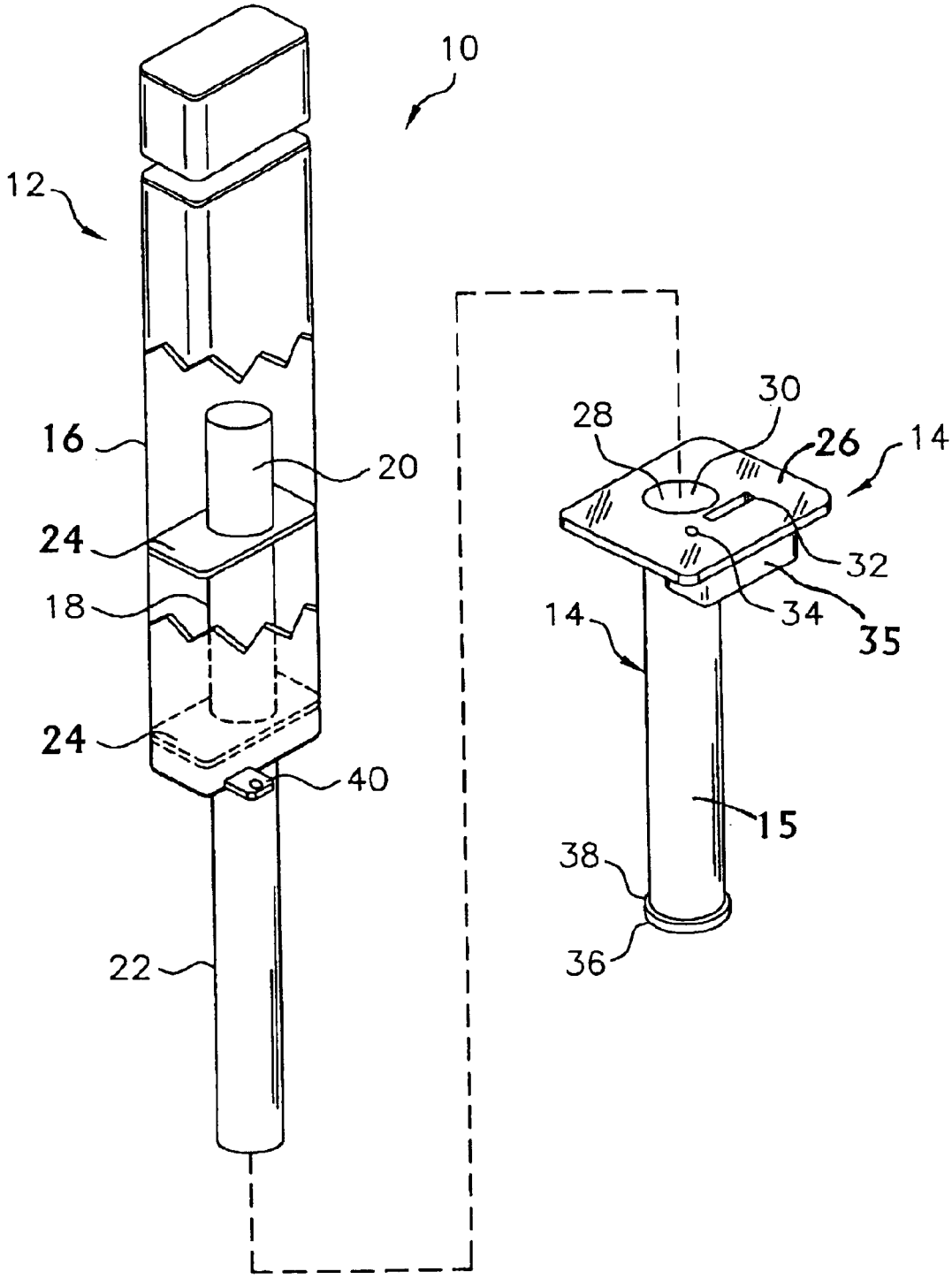
FIG. 1 is a cut-away exploded view of an embodiment of the present invention.

In FIG. 1 the bollard is depicted generally by numeral 10. Bollard assembly 10 includes post 12 and base 14. Post 12 includes an upper post member 16 and cylindrical member 18. Cylindrical member 18 has an upper portion 20 secured in a fixed position within upper post member 16 and a lower dependent portion 22 that depends from upper post member 16. A securing rider element 24 within upper post member 16 holds the cylindrical member 18 in place. Tack welds can be placed where securing rider element 24 and upper portion 20 of cylindrical member 18 meet to secure cylindrical member 18 to securing rider element 24 within post 18. Securing rider element 24 as here depicted comprises two spaced rider plates affixed to cylindrical member 18 and dimensioned to ride in the interior space of the upper post member 16, which is substantially hollow, and empty except for securing element 24 and upper portion 20 of cylindrical member 18. This helps to keep the post weight relatively low while the combination of securing member 24 and cylindrical member 18 tends to strengthen post 12.

Cylindrical member 18 is inserted into upper post member 24 through openings in the securing rider elements 24. Then the spot welding can be completed.

Base 14 has a base tube 15. Base 14 has a faceplate 26 with a first aperture 28 and a bore 30 in communication with said first aperture 28 for matingly receiving cylindrical member 18. Proximate first aperture 28 is a first locking aperture 32. Proximate said first locking aperture 32 is a second locking aperture 34. First locking aperture 32 and second locking aperture 34 directly overlie lock box 35. Base 14 has an end cap 36 at the lower end, forming a seal 38. End cap 36 is attached at the lower end of base 14. It is preferred that the attachment does not create a water-tight seal barrier. This is to permit drainage of water from the base while generally preventing or inhibiting the intrusion of sand and dirt. Generally, two spot welds will suffice.

Figure 2A:
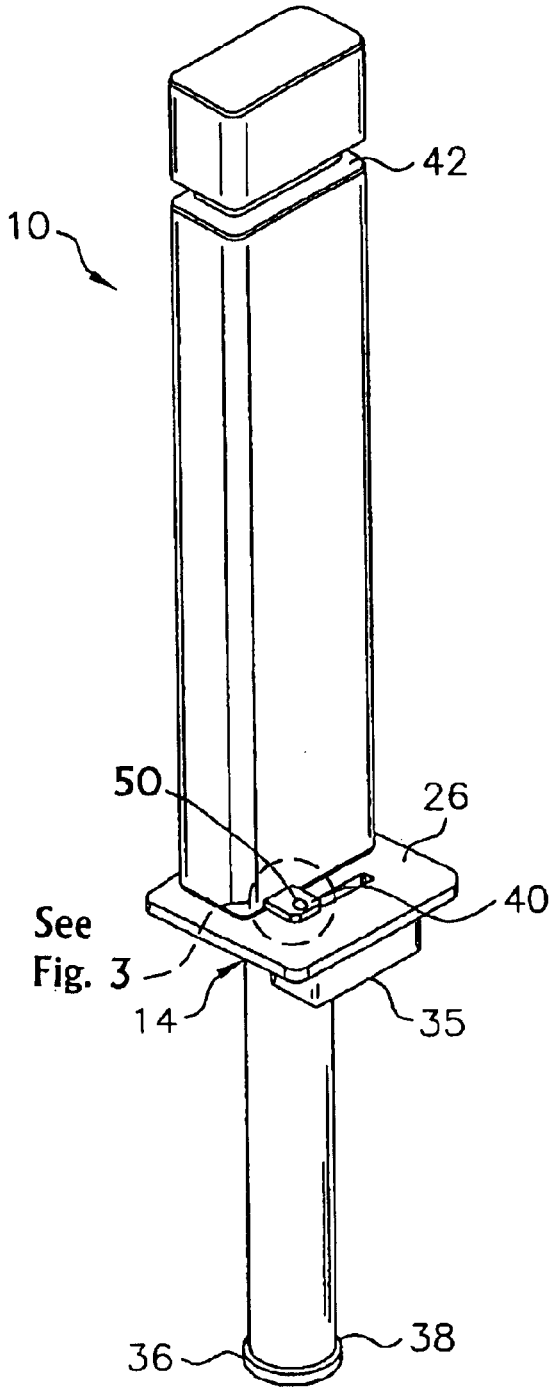
FIG. 2A is a perspective view of an embodiment of the present invention.
Figure 2B:
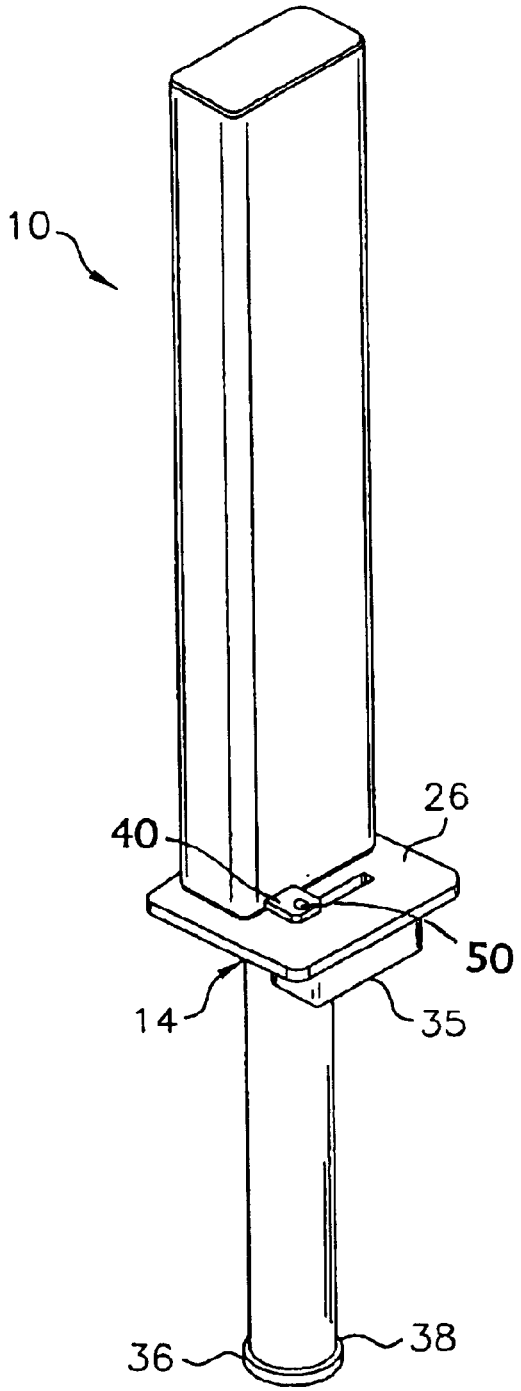
FIG. 2B is a perspective view of another embodiment of the present invention.

FIG. 2A and FIG. 2B depict the post with eye 50 of an eye cleat 40 (see also FIG. 3) aligned with second locking aperture 34 and adjacent to the first locking aperture 32 (see also FIG. 1) seated in base 14 of the depicted embodiments of the invention.

Figure 3:
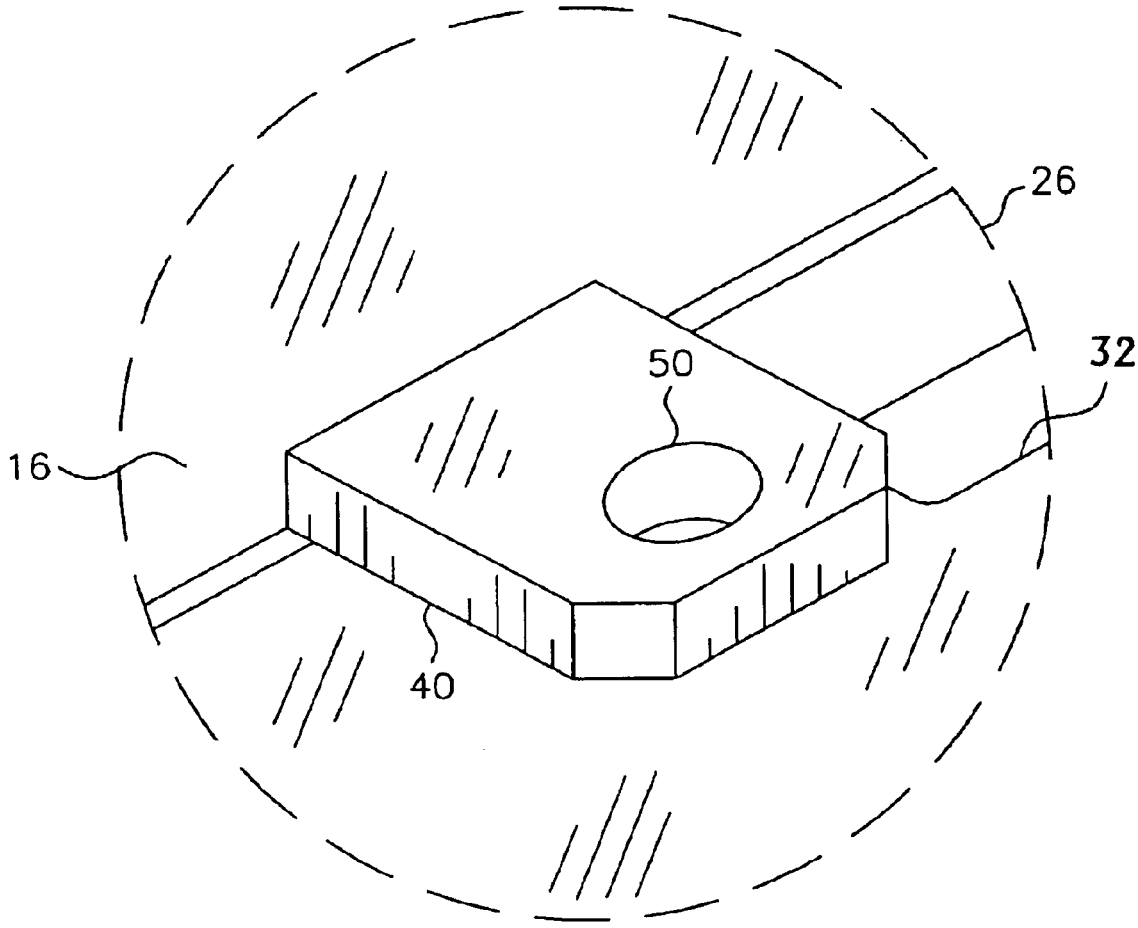
FIG. 3 is an enlarged view of the area identified in FIG. 2A and encircled by FIG. 4A is a top view of an embodiment of the base.

FIG. 3 depicts eye cleat 40, which is attached to post 16, adjacent to slot 32 when post 16 is inserted into base 14. Eye cleat 40 has an eye 50 that is aligned with second locking aperture 34 and in FIG. 3 is concealed under eve cleat 40.

Figure 4C:
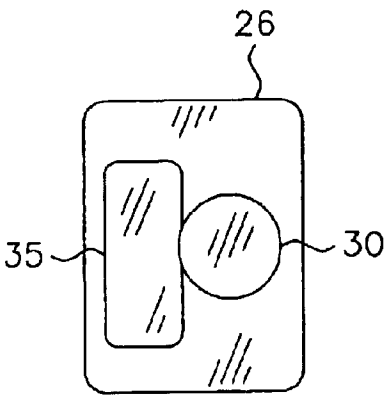
FIG. 4C is a bottom view of base of an embodiment of the invention.
Figure 4B:
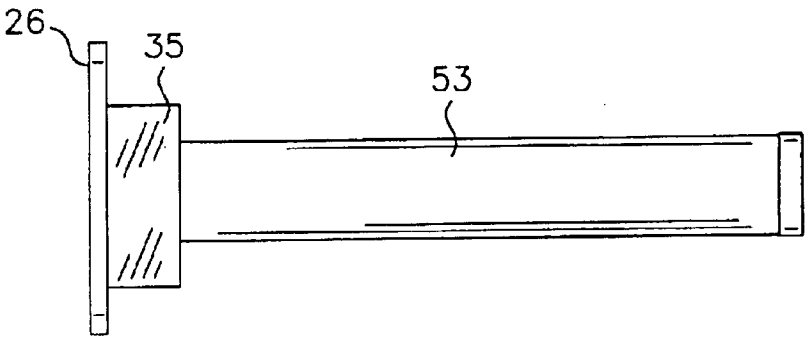
FIG. 4B is a side view of an embodiment of the invention, illustrating a base.
Figure 4A:
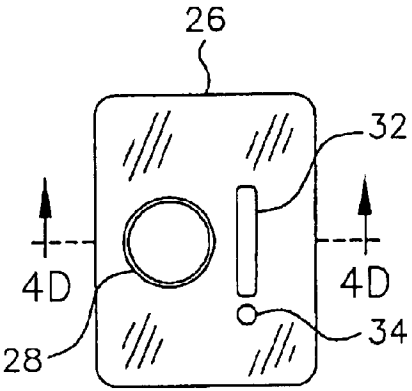
FIG. 4D is a sectional view of the base of an embodiment of the invention taken along line 4D—4D of FIG. 4A.
Figure 4D:
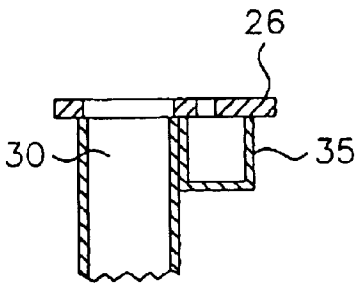

FIG. 4A through 4D show different views of base 14. FIG. 4A shows a top view. FIG. 4B shows a side view. FIG. 4C shows a bottom view. FIG. 4D depicts a front view. These figures show that the bore 30 is open from the top but appears closed from the bottom. They also show that the lock box 35 has an open cavity for communicating with first locking aperture 32 and second locking aperture 34.

Figure 5B:
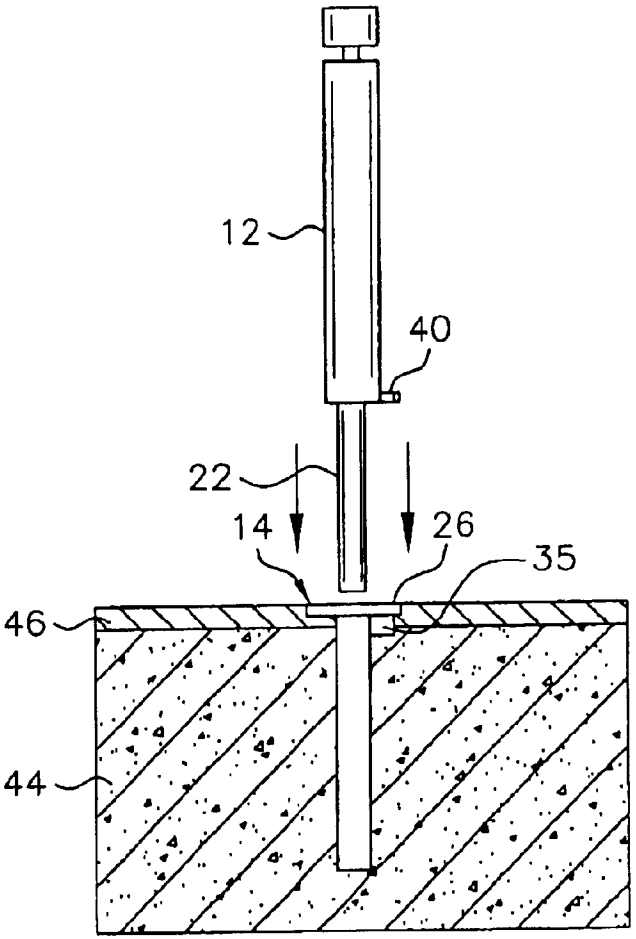
FIG. 5B is an exploded side view of an embodiment of the invention having a base installed in the ground, with face plate at ground level and the rest of the base extending downwardly further into the ground.
Figure 5A:
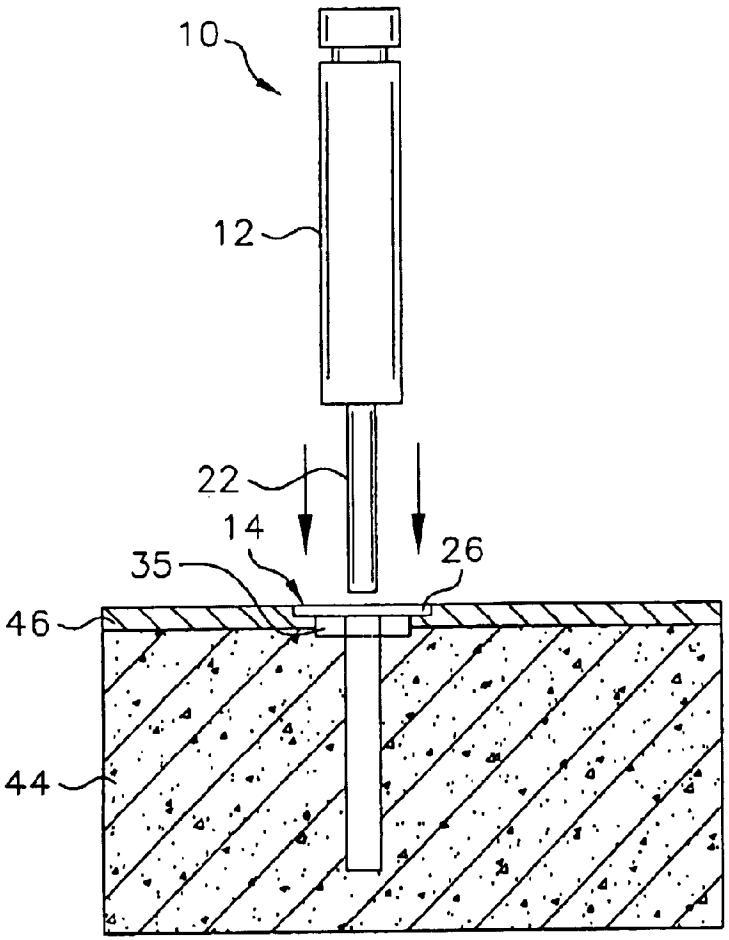
FIG. 5A is an exploded front view of the installation of an embodiment of the invention having a base installed in the ground and a post positioned for mating insertion into the base.

FIGS. 5A and 5B show bollard 10 in orthogonal views when being installed in the ground. The base 14 can be inserted into disparate media. Surface run-off water from rain, car washing or other sources can enter the top of the base 14, potentially filling it up with water that can freeze in the winter cold to hinder removal of the post 12. This underscores the advantage of having an outlet for the water to minimize the problem. The light tack welding of end cap 36 to permit fluid flow helps to alleviate this problem. In addition, the fact that dependent portion 22 of the post is cylindrical helps to facilitate its removal from cold or frozen ground by permitting rotation when the assembly is unlocked.

Figure 6A:
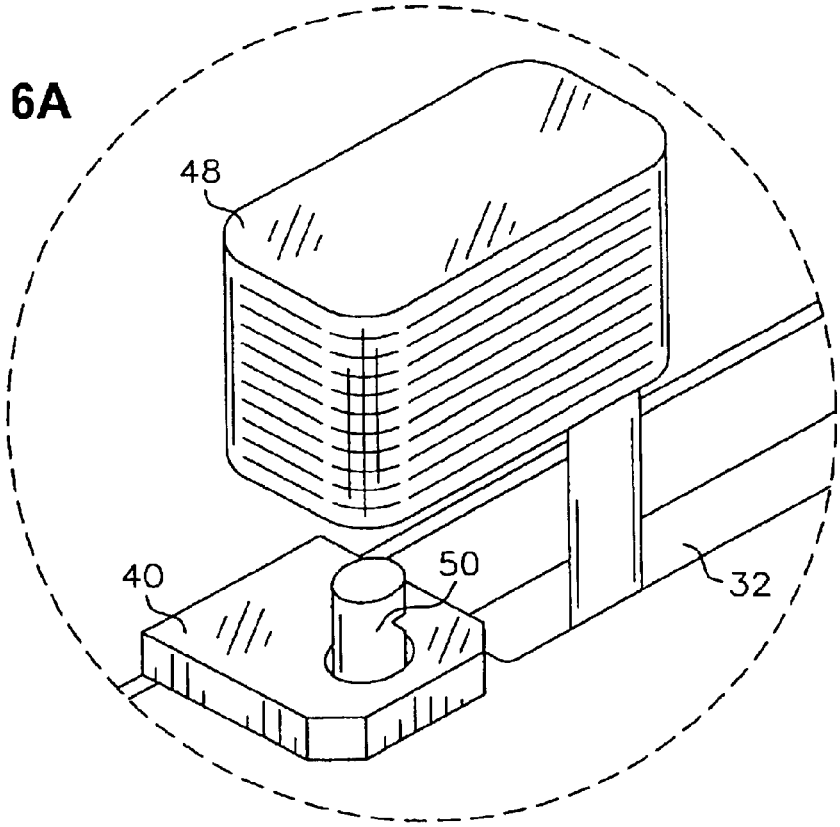
FIG. 6A is an enlarged view of an embodiment of the invention in almost locked position.
Figure 6B:
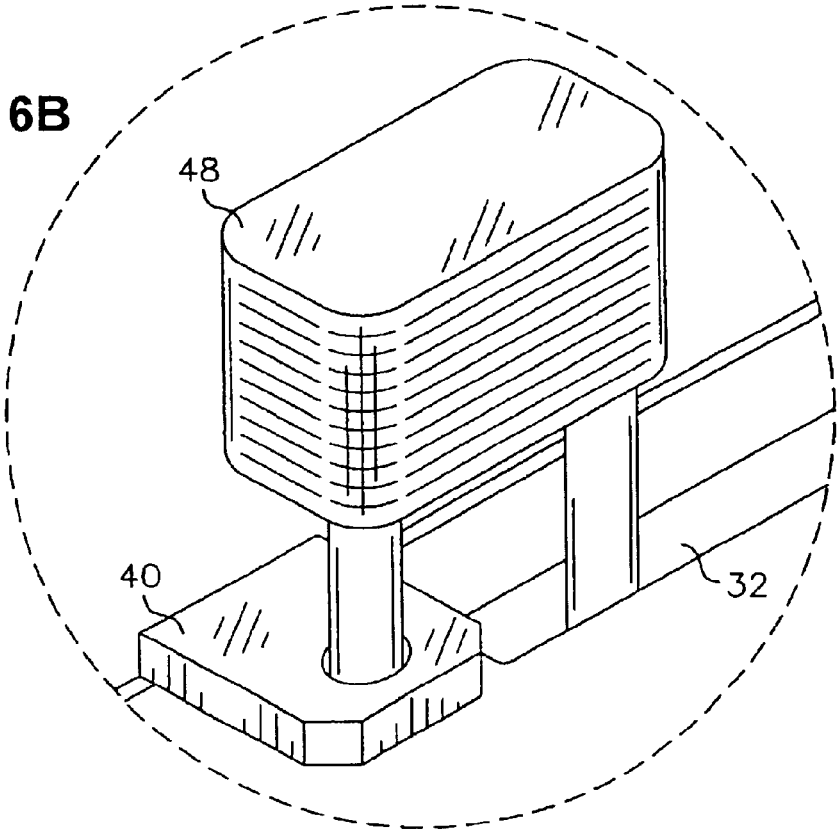
FIG. 6B is an enlarged view of an embodiment of the invention in a locked position.

FIG. 6A shows the U-bolt of a padlock 48 inserted first into aperture 32, down into the lock box 35 (lock box 35 is not shown in this view), and up through second locking aperture 34 and then through eye 50 of eye cleat 40. FIG. 6B shows the lock in a locked position. Thus the post is secured in the base to prevent unwanted tampering or removal.

What is claimed is:

1. A bollard, comprising:

a post having an upper post member, rider elements disposed within said upper post member, a cylindrical member having an upper portion that passes into the rider elements and is secured by the rider elements within the upper post member, the cylindrical member having a lower cylindrical portion that depends from the upper post member, a base having a bore for receiving the lower cylindrical portion of said post;

a plate at the upper portion of said base, said plate having a first aperture in communication with the bore of the base to permit receiving the cylindrical portion of said post by said base, said plate having a first locking aperture and an adjacent second locking aperture;

an eye cleat proximate the lower end of the upper post member of said post;

said eye cleat having an eye that can be placed proximate to and in alignment with the second locking aperture of the base plate when the post is mated with the base; and, wherein said upper post member is hollow and said lower cylindrical portion has an upper portion that is matingly received and secured in said upper post member.

2. The bollard of claim 1, further comprising a lock for affixing said eye cleat to the plate at the upper portion of the base, said lock engaging with said eye cleat aperture to secure the bollard to the base.

3. The bollard of claim 1, wherein a lower portion of the bore of said base has bottom fixture that substantially closes a lower end of the bore but does not prevent water flow.

4. The bollard of claim 1, wherein the upper post member is rectangular.

5. A bollard, comprising:

a post having an upper post member, rider elements disposed within a hollow of said upper post member, a cylindrical member having an upper portion that passes into the rider elements and is secured by the rider elements within the upper post member, the cylindrical member having a lower cylindrical portion that depends from the upper post member, a base having a bore for receiving the lower cylindrical portion of said post;

a plate at the upper portion of said base, said plate having a first aperture in communication with the bore of the base to permit receiving the cylindrical portion of said post by said base, said plate having a first locking aperture and an adjacent second locking aperture;

an eye cleat proximate the lower end of the upper post member of said post, said eye cleat having an eye that can be placed proximate to and in alignment with the second locking aperture of the base plate when the post is mated with the base; and, wherein said upper post member has substantially hollow interior and the rider elements within said hollow interior that guide and secure said upper portion therein.

6. A bollard, comprising:

a post having an upper post member, rider elements disposed within a hollow of said upper post member, a cylindrical member having an upper portion that passes into the rider elements and is secured by the rider elements within the upper post member, the cylindrical member having a lower cylindrical portion that depends from the upper post member, a base having a bore for receiving the lower cylindrical portion of said post;

a plate at the upper portion of said base, said plate having a first aperture in communication with the bore of the base to permit receiving the cylindrical portion of said Post by said base, said plate having a first locking aperture and an adjacent second locking aperture;

an eye cleat proximate the lower end of the upper post member of said post, said eye cleat having an eye that can be placed proximate to and in alignment with the second locking aperture of the base plate when the post is mated with the base; and, wherein the upper portion of the post has internal rider elements for securing said lower cylindrical portion.

* * * * *